US006645425B1

(12) United States Patent
Wienand et al.

(10) Patent No.: US 6,645,425 B1
(45) Date of Patent: Nov. 11, 2003

(54) REFRACTORY BATCH, IN PARTICULAR FOR THE PRODUCTION OF A SHAPED BODY, AND PROCESS FOR PRODUCING THE SHAPED BODY

(75) Inventors: Hans Wienand, Duesseldorf (DE); Helge Jansen, Friedland (DE); Peter Bartha, Bovenden (DE)

(73) Assignee: Refractechnik Holding GmbH, Ismaning (DE)

( * ) Notice: Subject to any disclaimer, the term of this patent is extended or adjusted under 35 U.S.C. 154(b) by 0 days.

(21) Appl. No.: 09/586,700

(22) Filed: Jun. 1, 2000

(30) Foreign Application Priority Data

Jun. 4, 1999 (DE) ..... 199 25 591

(51) Int. Cl.[7] ..... C21B 7/02

(52) U.S. Cl. ..... 266/280; 501/101; 501/99; 264/30; 266/286

(58) Field of Search ..... 266/280, 275, 266/286; 264/30; 501/95, 99, 101

(56) References Cited

U.S. PATENT DOCUMENTS 4,208,214 A * 6/1980 Stein et al. ..... 106/56
4,366,255 A * 12/1982 Lankard ..... 501/95
5,018,709 A * 5/1991 Cassens, Jr. et al. ..... 266/271

FOREIGN PATENT DOCUMENTS

DE 1039059 * 9/1958
JP 403093674 A * 4/1991
JP 404193770 A * 7/1992

* cited by examiner

*Primary Examiner*—Scott Kastler
(74) *Attorney, Agent, or Firm*—Goodman & Teitelbaum, Esqs.

(57) ABSTRACT

The invention relates to a refractory batch containing at least one refractory metal oxide component, at least one binder component, such as resin or pitch, if appropriate antioxidants, at least one carbon carrier, such as soot and/or graphite, and reinforcement fibers which are formed from a stainless steel material, which at the temperatures of use forms a coat of the refractory metal oxide on its surface, and to a shaped body made from the batch and to a process for producing the shaped body.

32 Claims, 1 Drawing Sheet

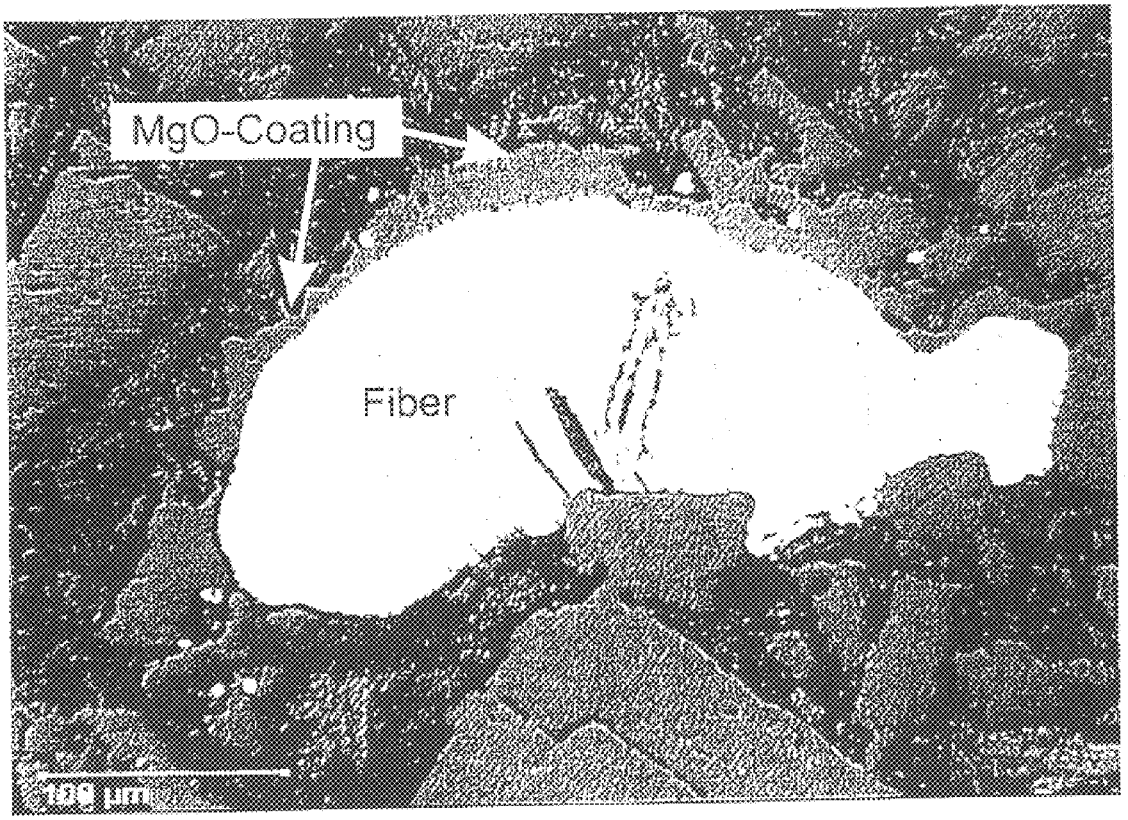
MgO-Coating
Fiber
100 µm

REFRACTORY BATCH, IN PARTICULAR FOR THE PRODUCTION OF A SHAPED BODY, AND PROCESS FOR PRODUCING THE SHAPED BODY

BACKGROUND OF THE INVENTION

The invention relates to a batch, in particular for the production of a refractory shaped body as described in the preamble of claim 1, to a refractory shaped body in accordance with the preamble of claim 29, and to a process for producing the shaped body in accordance with the preamble of claim 31.

In the iron and steelmaking industry, the reaction and transport vessels used are brick-lined with refractory materials or lined with ramming compounds. Vessels of this nature are, in particular, converters, such as basic oxygen furnaces or bottom-blowing converters, in which crude steel is obtained from pig iron. Furthermore, steel casting ladles and treatment ladles for secondary metallurgical processes (steel refining), and also downstream units in the steel casting system, are provided with a similar refractory lining.

In this case, steel casting ladles, for example, may both be lined with a high alumina content and have an alkaline lining based on MgO or dolomite.

In particular in converters, but also in steel ladles, it is customary to use linings in which the refractory material has a high content of a carbon carrier. This carbon carrier may be in the form of synthetic resins of any type, tar or pitch or graphite or mixtures of these constituents.

The functions of the carbon carriers are complex. However, the essential function of the carbon is to minimize slagging of the shaped bodies by reducing the wettability of the surface and, in addition, closing open pores.

In use, refractory shaped bodies of this nature become worn due to various operations carried out.

One wear mechanism is that relatively thin surface layers of the shaped body which have been infiltrated by slag wear away through dissolution, abrasion and spalling. This is known as thermochemical wear.

Thermomechanical wear, which takes place as a result of spalling of unchanged brick regions because of excessive thermomechanical stresses is also known.

In addition, carbon-containing shaped bodies also become worn as a result of decarburization of the layers on the hot side.

MgO is one of the most frequently used refractory raw materials.

Shaped bodies based on MgO are generally distinguished by a high refractory quality and a very good ability to withstand slags, in particular highly alkaline slags, i.e. they exhibit considerable advantages against thermochemical stresses. Drawbacks which can be mentioned in particular with regard to the thermal shock behavior is the relatively high coefficient of thermal expansion of MgO and its high modulus of elasticity. Furthermore, MgO has a relatively high thermal conductivity.

For refractory shaped bodies or refractory batches which have a high carbon carrier content as "slag inhibitor", in particular pitch-bonded shaped bodies, in particular based on magnesite, are known. These magnesite bricks, or alternatively dolomite bricks, can be produced with tar or pitch bonding. To enable pitch-containing binders to be used, these coarse-grained magnesite sinter mixtures are preheated to approximately 100° C. and higher as early as in the silo and are mixed in the hot state with pitch and any carbon additives and, if appropriate, crosslinking substances, in heatable mixers. After the shaped bodies have been pressed, they undergo heat treatment in a tempering furnace at approx. 300° C. The tempering increases the strength of the bricks and significantly reduces the susceptibility to spalling through the release of highly volatile hydrocarbons, in particular in the heat-up phase of the converter. With batches of this nature, it is ensured, inter alia, that raw materials with the lowest possible iron oxide and silicate content and a low boron content, a high sinter density and with large crystals (periclase) are used.

To increase the carbon content, and, in addition, to achieve an increase in the thermal conductivity, so that the heat can be dissipated more quickly in particular to water-cooled outside walls, it is known for refractory raw materials to be mixed with graphite and provided with resin or pitch bonding.

Furthermore, unfired shaped bodies, i.e. shaped bodies which have not been produced with a ceramic bond, but only from the bonding tar, are known, and shaped bodies which, in addition to the refractory oxide component (for example magnesite), contain a continuous bond formed by graphite platelets have been developed. Further developments envisaged using carbon in the form of soot, resulting in a longer service life of the shaped bodies. It has emerged that if relatively large amounts of graphite are used, synthetic resins (resol resins, novolak resins) are particularly suitable as binders for shaped bodies of this nature.

Therefore, working on the basis of tar-bonded sintered dolomite or magnesite bricks, pitch-bonded or resin-bonded two-component bricks have been developed which, with regard to the chemical resistance, combine the advantages of the refractory oxides and of the graphite.

In general, shaped bodies with resin bonding and graphite are produced by mixing the components in the cold state, shaping them under a high pressure and then hardening them at approximately 200° C. The hardening mechanisms depend, inter alia, on whether a one-component resin (resol resin) or a two-component resin with a hardener (novolak resins) is being used.

The resin content is usually between 2 and 5%, the graphite content may be between approximately 7 and 20%, with around 15% perhaps being regarded as customary.

To improve the service properties of carbon-containing bricks, it is additionally possible to add antioxidants, in particular in the form of metals, such as Al, Mg or Si.

In addition to the wear mechanisms which have already been described, during operation of the converter, steel scrap is added to the pig iron and is then melted down. This steel scrap is introduced into the converter, falls into the converter and in the process imposes considerable loads, in particular as a result of direct impact on the refractory lining. Furthermore, it is possible that mechanical wear may take place through stresses caused by temperature changes during heating or reheating after significant cooling, and this wear makes its presence felt by spalling. Furthermore, wear is caused by erosion in the area of power flows, for example at the pig iron impact point (casting jet impact and in nozzle regions).

The refractory lining is also subjected to substantial wear in other areas of steelmaking and steel processing, in particular in metallurgical ladles, especially also in the casting jet impact region. The service life of the units described is substantially determined by the wear at these principle points of loading.

To improve the mechanical resistance of such refractory linings, in particular refractory shaped bodies, it is proposed, in DE 196 43 111 A1, to introduce reinforcement bodies into the shaped bodies during production, which reinforcement bodies are to make the shaped body better able to withstand impact loads. The reinforcement bodies are to comprise in particular wire elements made from steel with a high heat resistance; an approximate Z shape of these elements is proposed as a particular embodiment.

Tests have shown, that reinforcement with steel wire of this nature, and also reinforcement with steel fibers in the form of a steel wool which is incorporated in the shaped body, do not enable such mechanical improvements to take place. On the one hand, it is not possible to compress the material which has been mixed with pieces of steel wire to the desired and required level of compaction. On the other hand, pressing results in an undesirable formation of compressed layers, in particular when using steel wool, and the inhomogeneities observed occur as early as during mixing. The steel reinforcement elements are drawn steel wires which are substantially elastically deformed in the brick during the pressing operation, i.e. the energy of deformation is stored so that after pressing, the brick is driven outwards again by the restoring forces in the drawn steel wires.

Consequently, satisfactory compaction of the brick material or sufficient dimensional accuracy and, correspondingly, a suitably green strength of the finished shaped body cannot be achieved. Furthermore, shaped bodies of this nature cannot be handled safely, since after pressing the restoring forces cause wire elements to project out of the surfaces of the shaped body, representing a significant risk of injury to the staff who are processing or fitting the shaped bodies.

Furthermore, the steel reinforcement elements begin to melt during use. Tests on shaped bodies fitted with steel elements after use have shown that the steel wires have fused completely and the molten material is dispersed finely through the microstructure of the brick, in particular along the grain boundaries and in the interstices, so that the steel wires can no longer be located as cohesive elements even after a short period of use. Consequently, steel wire elements or fibers of this nature—if they can be processed in the brick at all—can only contribute to a possibly improved strength in the green state of the brick. As soon as the shaped body has exceeded a certain temperature threshold or is in use, it is no longer possible to detect a positive effect from the steel fibers.

BRIEF SUMMARY OF THE INVENTION

The object of the invention is to provide a refractory batch which contains reinforcements, in particular for the production of shaped bodies, which has a high green strength for the shaped body, improved resistance to wear, in particular in the event of impact or shock loads, and an increased thermal shock resistance.

This object is achieved with a refractory batch or material, in particular for the production of a shaped body, having the features of claim 1, a refractory shaped body having the features of claim 29, and a process for producing the shaped body having the features of claim 31. Advantageous refinements are given in the subclaims.

According to the invention, the refractory batch or the refractory material contains at least one refractory metal oxide component, a binder component, such as resin or pitch, if appropriate antioxidants, in particular metallic antioxidants, a carbon carrier such as soot and/or graphite, and reinforcement fibers which are formed from a stainless steel material, which at the temperatures of use forms a coat of the refractory metal oxide.

According to the invention, the reinforcement body selected can be mixed with the remaining constituents of the batch without problems, in particular without forming clusters, layers or other inhomogeneities and, in addition, bonds successfully to the other components even during mixing. Furthermore, for the production of shaped bodies, the material for the reinforcement was selected in such a way that it is deformable or ductile to such an extent that, when the batch is pressed into shaped bodies, these reinforcement bodies do not store any significant energy of compression or deformation, so that elasticity which would cause the elements to seek to return to their original shape owing to restoring forces does not occur. Consequently, the reinforcement elements are pressed into the shaped body microstructure which is formed by the pressing without then driving the shaped body microstructure apart. Furthermore, a selection was made in such a way that the material forming the reinforcement bodies forms a layer of scale on the surface during heating of the batch, in particular as a shaped body, i.e. surface oxidation of the material takes place without this oxidation progressing too far into the interior of the material and thus destroying the element through further oxidation. Furthermore, the material was selected in such a way that transition to the liquid phase takes place as slowly as possible and only at temperatures which are as high as possible, so that the fibers retain their inherent stability as long as possible.

In addition, according to the invention it has been discovered that a coating or seam of the refractory oxide material forms on this thin, scaled surface of the reinforcement material, this seam being formed in such a manner that a refractory coat surrounding the reinforcement element is formed.

It has been found that, when the specially selected reinforcement elements and the coats formed are mixed in, imperfections in the shaped body can be produced in a controlled way in terms of type, size, shape, number and distribution. An advantage of the batch according to the invention is that the particular selection of the reinforcement material and its shape and size enable the mechanical and thermomechanical properties of a shaped body produced from the batch to be improved considerably. In particular in the cold temperature range, but also in the medium temperature range, increases in the strength, in particular including the tensile strength, were achieved, while in the high-temperature range a considerably increased resistance to impact and shock loads and a significantly improved resistance to thermal shocks were achieved. The improvement in the thermal shock resistance can be attributed to the controlled formation of the imperfections. The increase in the resistance or wear resistance to impact and shock loads can be attributed to the fact that the reinforcement elements which are in the liquid state in the high-temperature range, as a result of the refractory coating, act like cushions which, as hydraulic shock absorbers, are able to absorb impacts and shock.

In the following text, the invention is explained by way of example with reference to a figure and exemplary embodiments, the figure showing a cross section through a partial area of a shaped body formed from the batch according to the invention, in which a reinforcement element which is used according to the invention can be seen in cross section.

The refractory batch according to the invention comprises a refractory metal oxide. This metal oxide may in particular be $Al_2O_3$ (alumina), MgO (periclase) or dolomite. These raw materials are present together with the usual, known impurities. The raw materials are classified according to a desired grain size distribution, and in this way a desired grain range is achieved by combining the classes suitably. The grain range extends in particular from 0 to 10, and a typical grain size distribution may be from 0 to 6. The refractory metal oxide content in the batch may be between 70 M % and 100 M %.

If the refractory metal oxide used is magnesium oxide, it is preferable to use a magnesium oxide with a low iron oxide, silicate and boron content, a high sintered density and periclase crystals which are as large as possible; the MgO content is 97% or higher.

Furthermore, the batch according to the invention comprises a binder component. The binder component may be in the form of a one-component synthetic resin (resol resin) or a two-component synthetic resin (novolak resin). According to the invention, pitch bonding may also be desired, in which case the binder component used is pitch together with a hardener (nitrate, sulfur). If synthetic resins are used, they form from 1 M % to 5 M %, in particular from 2 to 3 M %, of the total batch.

The batch according to the invention also comprises a carbon carrier, in particular in the form of soot and/or graphite, the carbon carrier content in the total batch being between 0 M % and 30 M %, in particular between 11 and 15 M %. The batch may in addition contain antioxidants, in particular metallic antioxidants, such as silicon, aluminum or magnesium in amounts from 0% to 10%. The total carbon content after carbonization is between 0% and 30%.

Specially selected, melt-spun stainless steel fiber elements are used for the batch according to the invention. In particular, melt-spun steel fibers which are produced using the melt extract (ME) process or the melt overflow (MO) process are used. In the ME process, a rotating, water-cooled copper drum with a structured surface is immersed in molten stainless steel, the copper drum throwing the molten material centrifugally out of the crucible. In the process, the molten material, which is in the form of fibers, solidifies and is collected. Fibers obtained using the ME process have a diameter of, for example, 500 $\mu$m at a length of around 20 mm.

In the MO process, the rotating, water-cooled copper drum is arranged beneath an opening in the crucible containing the molten material, and the molten material is poured slowly onto the rotating drum. MO fibers can be made much thinner than ME fibers, and fibers obtained using the MO process are long fibers which can be used, for example, for fabrics. The MO fibers are sickle-shaped in cross section. According to the invention, it has been discovered that fibers produced using the MO process are particularly suitable if they are shorter than the MO fibers usually produced. The fibers used have a diameter of from 5 to 250 $\mu$m for a length of from 4 to 100 mm.

According to the invention, the material used to form the fibers is chromium steel, for example of the grade chromium-nickel steel 430, and/or chromium-nickel steel, for example of the grade chromium-nickel steel 310. The batch contains up to 3 M % (MO) fibers or up to 5 M % (ME) fibers; the batch may also contain mixtures of the two types of fiber.

To produce the batch, the grain range is compiled from a plurality of grain fractions. In particular, however, it is possible to assemble the grain range from grain fractions and to firstly branch off the dust, ultrafine and fine grain fraction from the desired grain range. The fibers or the reinforcement elements are firstly gradually admixed to this dust, fine and ultrafine grain fraction, for example with a grain size of from 0 to 100 $\mu$m, in a mixer, until the desired amount of reinforcement elements has been added. Then, mixing continues until the mixture is homogeneous, after which the dry carbon carrier, such as graphite or soot, is added. Then, the remaining, coarser fraction of the refractory metal oxide is gradually admixed to this preliminary mixture, until the entire mass of the refractory metal oxide has been homogeneously mixed with the fibers and the graphite. It is also possible for the preliminary mixture to be added to the remaining grain range of the refractory metal oxides, which is already situated in a mixer.

If resin-bonded shaped bodies are to be produced, the resin is then added to the cold mixer and mixed until the mixture is homogeneous. If a resin/hardener mixture is being used, the resin is premixed with the hardener, and the two components are added together, or alternatively first only the resin is added, followed by the hardener, mixing in each case taking place until the mixture is homogeneous. Moreover, it is possible for the mixture of the refractory metal oxide, the reinforcement elements and the carbon to be placed in a separate, dedicated mixer in order to be mixed with the resin or binder, where the mixing with the resin takes place. In addition, if desired, the batch contains antioxidants as well as further usual constituents, such as pressing aids, if required.

The finished batch mixture is fed to the pressers which are customary in the refractory industry where it is pressed into shaped bodies, for example using a pressure of 180 $N/mm^2$.

The finished resin-bonded shaped bodies are then subjected to the hardening step which is customary in this technique, at temperatures of between 120° C. and 200° C.

If pitch bonding of the batch according to the invention is to be the result, the process steps up to final mixing of the solid constituents, including any auxiliary constituents required, such as antioxidants and further known auxiliary constituents, are carried out, and then this preliminary mixture is added to a heated mixer, where this mixture is mixed with pitch and is homogenized. A pitch content of from 1% to 5% is particularly desired. After homogenization of the pitch, or during this homogenization, the crosslinking agents for the pitch are added, in particular sulfur and/or nitrate. After compression on the pressers which are customary for this technique, in particular heated pressers, the shaped bodies produced are subjected to a tempering step at 200° C. to 300° C., the pitch being crosslinked with the aid of the crosslinking agent.

The shaped bodies produced in the ways described above are then fitted at the appropriate locations in the furnace, converter or in the metallurgical ladle.

During heat-up and operation of the shaped body, a seam of the refractory metal oxide used, which coats the reinforcement element, forms around the fiber.

The figure shows an enlarged excerpt from a shaped body which has been formed from the batch according to the invention. The refractory metal oxide was in this case MgO (periclase). In the center of the picture, it is possible to see a cross section through a reinforcement element or a stainless steel fiber; the sickle-shaped or crescent-shaped cross section of the fiber—as can be seen—has not changed even after more than 200 hours of use. Around the fiber and adjacent to the fiber, it is possible to see the seam or the coating of the refractory metal oxide (MgO), which has evidently stabilized and secured the fiber in terms of its geometry and its arrangement in the shaped body, since the shape of the fiber in terms of its length has also not changed substantially (not shown in the figure). The seam of the refractory metal oxide surrounding the fiber on all sides, together with the fiber in the liquid state, i.e. in the high-temperature range, forms a type of elongate cushion.

The invention is explained below with reference to exemplary embodiments:

EXEMPLARY EMBODIMENT 1

An MgO sinter is classified. Fibers made from a chromium steel and obtained using the melt overflow process, with a diameter of 100 $\mu$m and a length of 6 mm, are added to the dust, ultrafine and fine grain fraction (≅10 to 20 M %), which has been placed in a mixer, in an amount of 1%, based on the total mass. Following homogenization, 10% of flake graphite is added, and homogenization takes place. From the remaining fractions of the classified MgO sinter, a grain composition or grain range with a typical grain distribution curve for magnesite-carbon bricks is mixed together in a mixer. The fine fraction together with the fibers and the graphite is then admixed to this coarse fraction of the refractory metal oxide. After homogenization has taken place, 2% of a resol synthetic resin is added in a separate mixer, and mixing takes place until the mixture is homogeneous. The batch which has been obtained in this way is then pressed on a hydraulic press under a pressure of 180 MPa. There is no evidence of any change in volume or length of the pressed part after pressing. The shaped bodies obtained in this way are then hardened at 200° C. and then used in practice. When used in a steel casting ladle, the wear in the area of the casting jet impact is reduced by 10 to 15% with a shaped body made from the abovementioned batch according to the invention.

EXEMPLARY EMBODIMENT 2

An MgO sinter is classified as in Exemplary Embodiment 1. Fibers made from a chromium steel (for example of grade chromium steel 430) which have been obtained using the melt overflow process and have a diameter of 100 $\mu$m and a length of 20 mm are added to the dust, ultrafine and fine grain fraction (approx. 10 to 20 M %), which has been placed in a mixer, in an amount of 1 M %, based on the total mass. After homogenization, 5% of a graphite is added, and homogenization takes place. A grain composition or a grain range with a typical grain distribution curve for magnesite-carbon brick is mixed together in a mixer from the remaining fractions of the classified MgO sinter, as in Exemplary Embodiment 1. The further process steps correspond to the process steps from Exemplary Embodiment 1.

In the refractory batch according to the invention in particular for the production of shaped bodies, it is advantageous that, because of the special selection of the steel reinforcement elements, for the first time refractory raw material, carbon carrier and reinforcement elements have been made extremely easy to process in a single mass, the reinforcement elements producing a change in shape after pressing through the elastic accumulation of deformation forces. Furthermore, formation of inhomogeneities during mixing and the formation of layers during pressing are suppressed. A further advantage is that the special selection of the material forming the reinforcement elements has made it possible to form a ceramic coat around these elements, so that the reinforcement elements retain their original shape even in the high-temperature range. A further advantage is that the reinforcement elements, together with the refractory coating, form a large number of imperfections and cushions in the microstructure of the shaped body, which are able, firstly, to significantly increase the thermal shock resistance and, secondly, to absorb impacts and shocks caused in particular by scrap striking the converter, in the manner of hydraulic shock absorbers in the microstructure of the shaped bodies. According to the invention, therefore, a refractory batch in particular for the production of shaped bodies which makes it possible to produce shaped bodies which have an improved resistance to wear in particular caused by shock and impacts, and to thermomechanical and mechanical stresses, is produced. Furthermore, the advantages described can also be achieved if the refractory batch according to the invention is used for spraying or ramming compounds and for mortars.

What is claimed is:

1. A refractory batch or refractory material for producing a shaped body, comprising:

at least one refractory metal oxide component, a blinder component including resin or pitch, antioxidants as required, at least one carbon carrier, and reinforcement fibers which are formed from a stainless steel material, the stainless steel material being ductile melt-spun fibers so that, at the temperatures of use, the refractory metal oxide component coats the ductile melt-spun fibers, whereby the reinforcement fibers do not store any significant energy of compression or deformation when the refractory batch or refractory material is pressed into the shaped body, so that any elasticity, which would cause the shaped body to return to its original shape due to restoring forces, does not occur.

2. The batch as claimed in claim 1, wherein the refractory metal oxide component contains substantially MgO.

3. The batch as claimed in claim 1, wherein the refractory metal oxide component is a high-purity, natural or synthetic MgO sinter.

4. The batch as claimed in claim 1, wherein the refractory metal oxide component contains substantially dolomite.

5. The batch as claimed in claim 4, wherein the refractory metal oxide component is a natural or synthetic dolomite sinter.

6. The batch as claimed in claim 1, wherein the refractory metal oxide component is $Al_2O_3$.

7. The batch as claimed in claim 6, wherein the refractory metal oxide component is tabular alumina.

8. The batch as claimed in claim 1, wherein the binder component comprises a one-component synthetic resin.

9. The batch as claimed in claim 1, wherein the binder component comprises a two-component synthetic resin.

10. The batch as claimed in claim 1, wherein the binder component comprises pitch.

11. The batch as claimed in claim 10, wherein the batch comprises crosslinking reagents for the pitch.

12. The batch as claimed in claim 1, wherein the antioxidants are metallic antioxidants.

13. The batch as claimed in claim 12, wherein the metallic antioxidants are silicon and/or aluminum and/or magnesium.

14. The batch as claimed in claim 1, wherein the refractory metal oxide component has a uniform grain size selected from any one size from 0 to 10 mm.

15. The batch as claimed in claim 1, wherein the refractory metal oxide component has a grain size distribution selected from various sizes within a range of 0 to 10 mm.

16. The batch as claimed in claim 1, wherein the refractory metal oxide component content in the batch is between 70 M % and 100 M %.

17. The batch as claimed in claim 1, wherein the binder component is a resol resin and/or a novolak resin.

18. The batch as claimed in claim 1, wherein a synthetic resin is present in an amount from 1 to 5 M %.

19. The batch as claimed in claim 1, wherein the pitch is present in an amount of 1 to 5 M %.

20. The batch as claimed in claim 1, wherein the carbon carrier is present in an amount from 0 M % to 30 M %.

21. The batch as claimed in claim 1, wherein metallic antioxidants are present in an amount of from 0% to 10%.

22. The batch as claimed in claim 1, wherein the reinforcement fibers include stainless steel fibers which are produced using a melt overflow process.

23. The batch as claimed in claim 1, wherein the reinforcement fibers include stainless steel fibers which are produced using a melt extract process.

24. The batch as claimed in claim 1, wherein the reinforcement fibers have a diameter of from 5 to 250 $\mu$m with a length of from 4 to 100 mm.

25. The batch as claimed in claim 1, wherein the fibers are sickle-shaped or crescent-shaped in cross section.

26. The batch as claimed in claim 1, wherein the fibers are formed from a chromium steel and/or chromium-nickel steel.

27. The batch as claimed in claim 1, wherein the batch contains up to 3 M % fibers produced using a melt overflow process.

28. The batch as claimed in claim 1, wherein the batch contains up to 5 M % fibers produced using a melt extract process.

29. A process for producing a shaped body, comprising the steps of:

using a batch, in which:

(1) a refractory metal oxide is classified, and (2) a desired grain range is put together from a plurality of grain fractions, mixing stainless steel fibers with one, a plurality of or all of the grain fractions until a homogenous mixture is formed, mixing the stainless steel with the remaining grain fractions, as required, in order to form the homogenous mixture, admixing a dry carbon carrier to the mixture of refractory metal oxide components and stainless steel fibers, and forming the stainless steel fibers from ductile melt-spun fibers so that at the temperatures of use, the refractory metal oxide components coat the ductile melt-spun fibers, wherein the ductile melt-spun fibers do not store any significant energy of compression or deformation when the batch is pressed into the shaped body, so that any elasticity, which would cause the shaped body to return to its original shape due to restoring forces, does not occur.

30. The process as claimed in claim 29, wherein a one-component or two-component synthetic resin and, auxiliary constituents, as required such as antioxidants, are admixed to the mixture of refractory metal oxide component, stainless steel fibers and dry carbon carrier, and the entire mixture obtained is then pressed into shaped bodies, after which it is subjected to hardening at temperatures of between 120 and 200° C.

31. The process as claimed in claim 30, wherein the mixture of refractory metal oxide component, stainless steel fibers and dry carbon carrier is, if appropriate, added to pitch in a heatable mixer, and the entire mixture is homogenized, crosslinking reagents for the pitch are added to the mixture, and then the mixture is pressed into shaped bodies, after which the shaped bodies are tempered at a temperature of from 200 to 300° C. until the pitch has crosslinked with the crosslinking agents.

32. A shaped body for lining converters, casting ladles, metallurgical ladles and similar units for steel processing and treatment, at a temperature of use, comprising:

stainless steel fibers;

a coating or deposit of a refractory metal oxide contained in a batch;

the batch being deposited on a surface of the stainless steel fibers;

the batch including binder means so that once the coating has been formed, and even when the coating has been cooled, the coating is retained on the surface;

the binder means including resin or pitch; and the stainless steel fibers being ductile melt-spun fibers to permit the coating thereon;

whereby the ductile melt-spun fibers do not store any significant energy of compression or deformation when the batch is pressed into the shaped body, so that any elasticity, which would cause the shaped body to return to its original shape due to restoring forces, does not occur.

* * * * *